US005889646A

United States Patent [19]

Strauss

[11] Patent Number: 5,889,646

[45] Date of Patent: Mar. 30, 1999

[54] CIRCUIT CONFIGURATION AND METHOD FOR TRIGGERING AT LEAST ONE ELECTRICALLY TRIGGERABLE MAGNET

[75] Inventor: Georg Strauss, Giengen, Germany

[73] Assignee: BSH Bosch und Siemens Hausgeraete GmbH, Munich, Germany

[21] Appl. No.: 805,328

[22] Filed: Feb. 24, 1997

Related U.S. Application Data

[63] Continuation of PCT/EP95/02620 filed Jul. 6, 1995.

[51] Int. Cl.[6] ..... H01H 9/00

[52] U.S. Cl. ..... 361/194; 361/153; 361/170

[58] Field of Search ..... 361/152, 153, 361/154, 194, 161, 206, 170

[56] References Cited

U.S. PATENT DOCUMENTS

| | | | |
|---|---|---|---|
| 3,634,735 | 1/1972 | Komatsu et al. | 317/154 |
| 4,455,587 | 6/1984 | Potthof et al. | 361/160 |
| 4,797,779 | 1/1989 | Richards et al. | 361/154 |
| 4,908,731 | 3/1990 | Richeson, Jr. | 361/159 |
| 5,394,131 | 2/1995 | Lungu | 335/229 |
| 5,552,954 | 9/1996 | Glehr | 361/191 |

*Primary Examiner*—Jeffrey Gaffin
*Assistant Examiner*—Kim Huynh
*Attorney, Agent, or Firm*—Herbert L. Lerner; Laurence A. Greenberg

[57] ABSTRACT

In a circuit configuration and a method for triggering at least one electrically triggerable magnet with a suitably targeted triggering power, the magnet switches a switching element into a desired switching position in which the switching element is retained. After the switchover of the switching element by the magnet into the desired switching position, the magnet is at least briefly repeatedly acted upon at predetermined time intervals with a triggering power corresponding to a desired switching position.

8 Claims, 3 Drawing Sheets

CIRCUIT CONFIGURATION AND METHOD FOR TRIGGERING AT LEAST ONE ELECTRICALLY TRIGGERABLE MAGNET

CROSS-REFERENCE TO RELATED APPLICATION

This application is a Continuation of International Application Serial No. PCT/EP95/02620, filed Jul. 6, 1995.

BACKGROUND OF THE INVENTION

Field of the Invention

The invention relates to a circuit configuration and a method for triggering at least one electrically triggerable magnet with a suitably targeted triggering power, through which the magnet switches a switching element into a desired switching position in which the switching element is retained.

In order to trigger bistable magnet valves used in multi-temperature refrigerators, circuit configurations and methods as defined above are known that serve to control a flow of refrigerant to evaporators located in compartments of different temperature. Such circuit configurations used in refrigerators have a logic section on the input side that is used to evaluate control parameters, such as temperature regulator signals. With the aid of the logic section a triac or two antiparallel thyristors on the circuit output side are triggered in order to act upon the bistable magnet valve with the appropriate triggering power. In those semiconductor components, power surges in the mains supply voltage can cause so-called "overhead ignition", by which an unintended trigger pulse to the magnet valve is generated that then shifts the magnet valve out of a desired position dictated by the temperature regulator signals into its contrary switching position. Such an event can mean that the temperature in one freezer compartment of a two-temperature refrigerator appliance rises above the permitted value, so that the food stored in it is markedly impaired, at least in appearance and taste, while on the other hand a temperature drop in the refrigerator compartment of the appliance can mean that containers cooled with liquid refrigerant are destroyed.

SUMMARY OF THE INVENTION

It is accordingly an object of the invention to provide a circuit configuration and a method for triggering at least one electrically triggerable magnet, which overcomes the hereinafore-mentioned disadvantages of the heretofore-known devices of this general type in such a way that an unintentionally effected change of position of a required switching position of the electrically triggerable magnet is averted in a simple way.

With the foregoing and other objects in view there is provided, in accordance with the invention, a circuit configuration and a method for triggering at least one electrically triggerable magnet with a suitably targeted triggering power, comprising a device for switching a switching element with a magnet into a desired switching position in which the switching element is retained; and a device for at least briefly repeatedly acting upon the magnet at predetermined time intervals with a triggering power corresponding to a desired switching position, after the switchover of the switching element by the magnet into the desired switching position.

As a result of the structure and mode of operation of the invention it is assured that the electrically triggerable magnet is always held securely in its required switching position without additional monitoring and attendant evaluation provisions, so that unintended mispositions of the electrically triggerable magnet that could possibly cause damage are reliably prevented.

In accordance with another mode and feature of the invention, semiconductor components are provided for acting upon the magnet with the triggering power, the semiconductor components are acted upon repeatedly at predetermined time intervals with a trigger signal serving to furnish the triggering power after the switchover of the switching element into the desired switching position.

Through the use of such a structure and mode of operation, an electromagnet can be triggered especially economically and simply, and the triggering elements can be rapidly replaced in the event of damage.

In accordance with a further mode and feature of the invention, time intervals between the trigger signals are dimensioned to be equally long. This provides an especially simple concept for a logic circuit, with which the possibility of the occurrence of a misposition of the electrically triggerable magnet is minimized at the same time.

In accordance with an added mode and feature of the invention, the triggering power is formed by the half-waves of an alternating voltage, a plurality of half-waves immediately succeeding one another are generated as a signal train, and two successive signal trains are spaced apart from one another by a period of time that is long as compared to a cycle time of the half-waves.

Through the use of such a structure and mode of operation, the required switching position of a switching element actuated by the electromagnet is adequately assured, and at the same time the energy consumption by the circuit configuration and the stress on it are minimized.

In accordance with a concomitant mode and feature of the invention, the circuit configuration is triggered especially exactly as needed by the appropriate influencing variables if the generation of the trigger signals is effected automatically by a trigger unit as a function of at least one triggering parameter.

Other features which are considered as characteristic for the invention are set forth in the appended claims.

Although the invention is illustrated and described herein as embodied in a circuit configuration for triggering at least one electrically triggerable magnet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
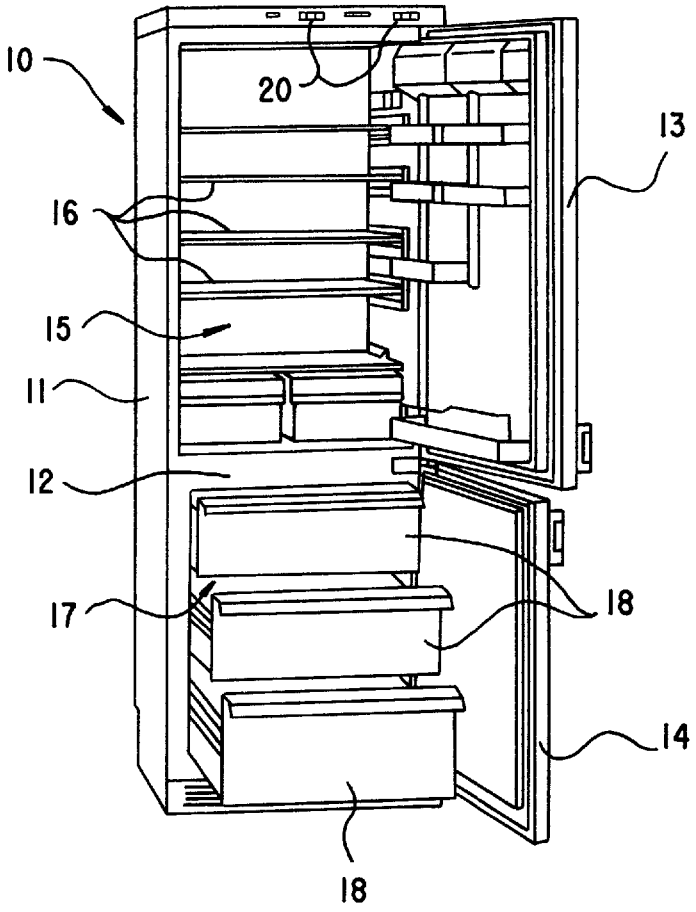
FIG. 1 is a diagrammatic, perspective view of a two-temperature refrigerator shown with opened doors and having a refrigerator compartment and a freezer compartment with temperatures that are controlled by an electronic regulating device.

Referring now to the figures of the drawings in detail and first, particularly, to FIG. 1 thereof, there is seen a combination refrigerator and freezer 10 having a heat-insulating housing 11 with two storage compartments disposed vertically one above the other, thermally separated from one another by a heat-insulating partition 12 and closable with separate doors 13 and 14. The higher storage compartment which is closable with the door 13, is constructed as a refrigerator compartment 15 that is equipped with shelves 16 disposed one above the other at vertical intervals and intended for storing things to be refrigerated. The other storage compartment 13 which is located below the refrigerator compartment 15, separated from it by the heat-insulating partition 12 and closable by the door 14, is constructed as a freezer compartment 17 that is equipped with frozen-product containers 18 which can be pulled out like drawers to hold things to be frozen.

In order to maintain their intended storage chamber temperatures, both the refrigerator compartment 15 and the freezer compartment 17 are equipped with non-illustrated evaporators which are incorporated into a likewise non-illustrated refrigeration circuit within which a compressor that supplies the evaporators with liquid refrigerant is disposed. The compressor is operated intermittently and phases in which the compressor is turned on and off are dependent on the temperatures prevailing in the storage compartments. On one hand, these temperatures are detected by non-illustrated temperature sensors and processed to form values that can be indicated by temperature indicator elements in an evaluation logic element 19 of FIG. 2 that is part of an electronic regulating device. On the other hand as is seen in FIG. 2, they are processed into digital signals "A" and "B" that can be further processed in a circuit configuration 30.

Figure 2:
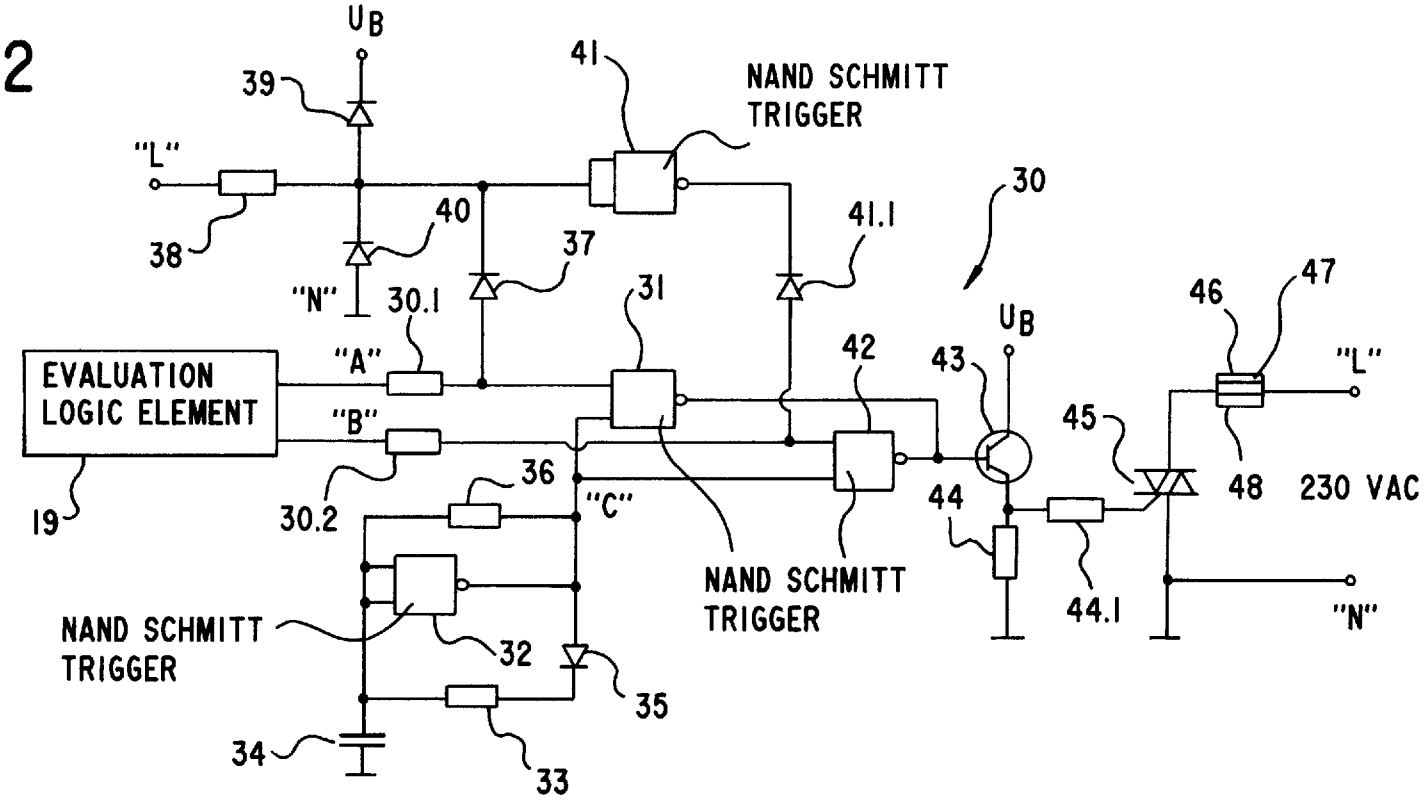
FIG. 2 is a schematic and block circuit diagram of the electronic regulating device with an electronic circuit configuration for generating trigger signals to secure a switching position required for a bistable magnet valve that controls a flow of refrigerant to the various compartments.

As seen particularly in FIG. 2, the digital signals "A" and "B" which are present at an output side of the evaluation logic element 19 represent input signals for the circuit configuration 30. A positive output signal "A" signals a demand for refrigeration for the refrigerator compartment 15, while a positive output signal "B" represents a demand for refrigeration for the freezer compartment 17. The output signal "A" which is present at the evaluation logic element 19 is supplied for further processing through a current limiting resistor 30.1 to one input of a NAND gate 31. The NAND gate 31 has another input which is acted upon by an input signal "C". The signal can assume a voltage level of either logical "1" or logical "0", which are each generated by a NAND Schmitt trigger 32 having two inputs that are interconnected. The duration of the particular signal state has a variably long dimension. In the case of the logical level "1", this duration is the result of the charging time of an ohmic resistor 33 and a capacitor 34 having a cathode connected to ground potential. In order to define the direction of the charging current, the RC element is preceded by a diode 35 that has a cathode terminal which is coupled to the ohmic resistor 33. The duration of the logic level "0" for the input signal "C" is determined by an RC element that is formed of the capacitor 34 and an ohmic resistor 36. The resistor 36 has a resistance which is markedly above that of the ohmic resistor 33, in order to generate a longer duration for the logic level 0. Elements 32, 33, 34, 35 and 36 form a trigger unit.

Moreover, an output of the evaluation logic element 19 which furnishes the digital signal "A" is also connected to an anode terminal of a diode 37. The diode 37 is connected to a circuit portion that belongs to the circuit configuration 30 and that serves to evaluate an alternating voltage which is typically required to operate household appliances. The alternating voltage is coupled by a line pole "L" of an alternating voltage grid to a resistor 38 serving to limit current for operating logic components. The resistor 38 is connected to two series-connected diodes 39 and 40. The diode 39 has a cathode terminal connected to a positive pole of a direct voltage source $U_B$, while the diode 40 has an anode terminal connected to ground potential, which at the same time forms a zero pole "N" of the alternating current. A potential which is established in each case at a junction between the series-connected diodes 39 and 40, is supplied on the input side to a NAND Schmitt trigger 41. An output of the NAND Schmitt trigger 41 is connected to a cathode terminal of a diode 41.1. An anode side of the diode 41.1 is connected to one input of a NAND Schmitt trigger 42 which at the same time is also acted upon by the output signal B of the evaluation logic element 19. The signal "C" is present at another input of the NAND Schmitt trigger 42. An output of the NAND Schmitt trigger 42, like that of the NAND Schmitt trigger 31, is connected to a base of a pnp transistor 43. The transistor 43 has an emitter terminal which is connected to a direct voltage supply $U_B$ and a collector terminal which is connected to ground through an ohmic resistor 44 that limits the collector current to ground potential. A gate terminal is disposed between the collector terminal of the pnp transistor 43 and the ohmic resistor 44. The gate terminal is connected to a current-limiting pilot resistor 44.1, for tapping an ignition current of a semiconductor component in the form of a triac 45. A bistable electrically triggerable magnet valve 46 that switches between two flow paths and is coupled to a line pole "L" of a 230 V alternating voltage, is connected to a main electrode terminal of the triac. Another main electrode of the triac 45 is connected to a zero pole "N" of the alternating voltage supply.

In the event that the refrigerator compartment 15 requires refrigeration because of a rising temperature therein, this need is detected by a sensor, already mentioned above, that monitors the cooling air temperature. A signal thereupon generated by the temperature sensor is converted by the evaluation logic element 19 into a logical "1" at its output "A". This level, which is supplied to the appropriate input of the NAND Schmitt trigger 31, together with an identical level generated by the signal "C", effects a low level (logical "0") at the output of the NAND Schmitt trigger 31 that acts on the base of the pnp transistor 43 which acts as a switch, thereby converting this transistor to the conducting state.

The input signal "C" at the input of the NAND Schmitt trigger 31, which is generated automatically by the connection of the NAND Schmitt trigger 32, is only present as a high level (logical "1") during the charging time of the capacitor 34 through the resistor 33, and it has a low level for the discharging duration of the capacitor 34 through the resistor 36. Both level states are effected by exceeding or falling below a predetermined switching threshold at the input-linked NAND Schmitt trigger 32.

The output signal of the NAND Schmitt trigger 31 is also influenced by the evaluation of the mains alternating voltage for operating the combined refrigerator-freezer (such as 230V). Both the diode 40 and the diode 37 are put into a conducting state by the negative half-wave of this sinusoidal alternating voltage, so that for approximately the duration of this half-wave, a low level is present at the input of the NAND Schmitt trigger 31 which is acted upon by the signal A, and as a result the output of the NAND Schmitt trigger 31 shifts to a high level and the pnp transistor 43 thus blocks. Conversely, the positive half-wave of the sinusoidal alternating voltage cannot have any influence on the low level originally established at the output of the NAND Schmitt trigger 31, so that the pnp transistor 43 which is thus switched through and the attendant ignition of the triac 45 cause current to be supplied to the bistable electromagnet valve 46. As a result thereof the desired change of position of the final control element of the valve takes place for diverting the refrigerant to the evaporator of the refrigerator compartment 15.

The exertion of influence is hindered by the connection of the output "A" of the evaluation logic element 19 and the input of the NAND Schmitt trigger 41 to the diode 37, which is disposed in the blocking direction with respect to the output "A". This is because when there is a low level at the output A, which represents no requirement for refrigeration, as a result of the positive half-wave of the sinusoidal alternating voltage there can be no low level at the input of the NAND Schmitt trigger 31 that would impermissibly cause the transistor 43 to be made conducting.

Figure 3:
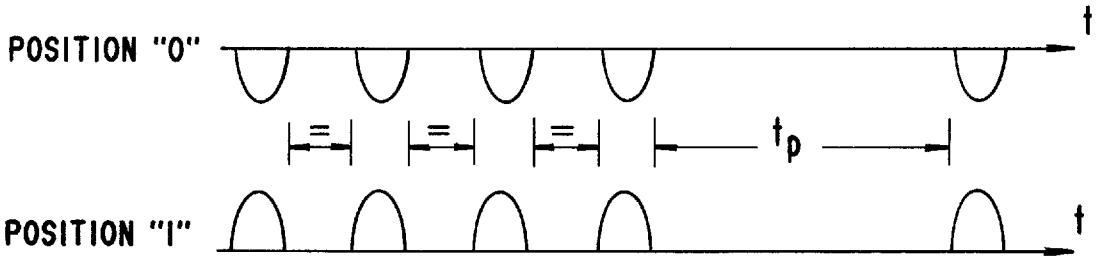
FIG. 3 is a diagram showing trigger signals corresponding to the two switching positions of the bistable magnet valve, with each signal plotted on a time axis.
Figure 4:
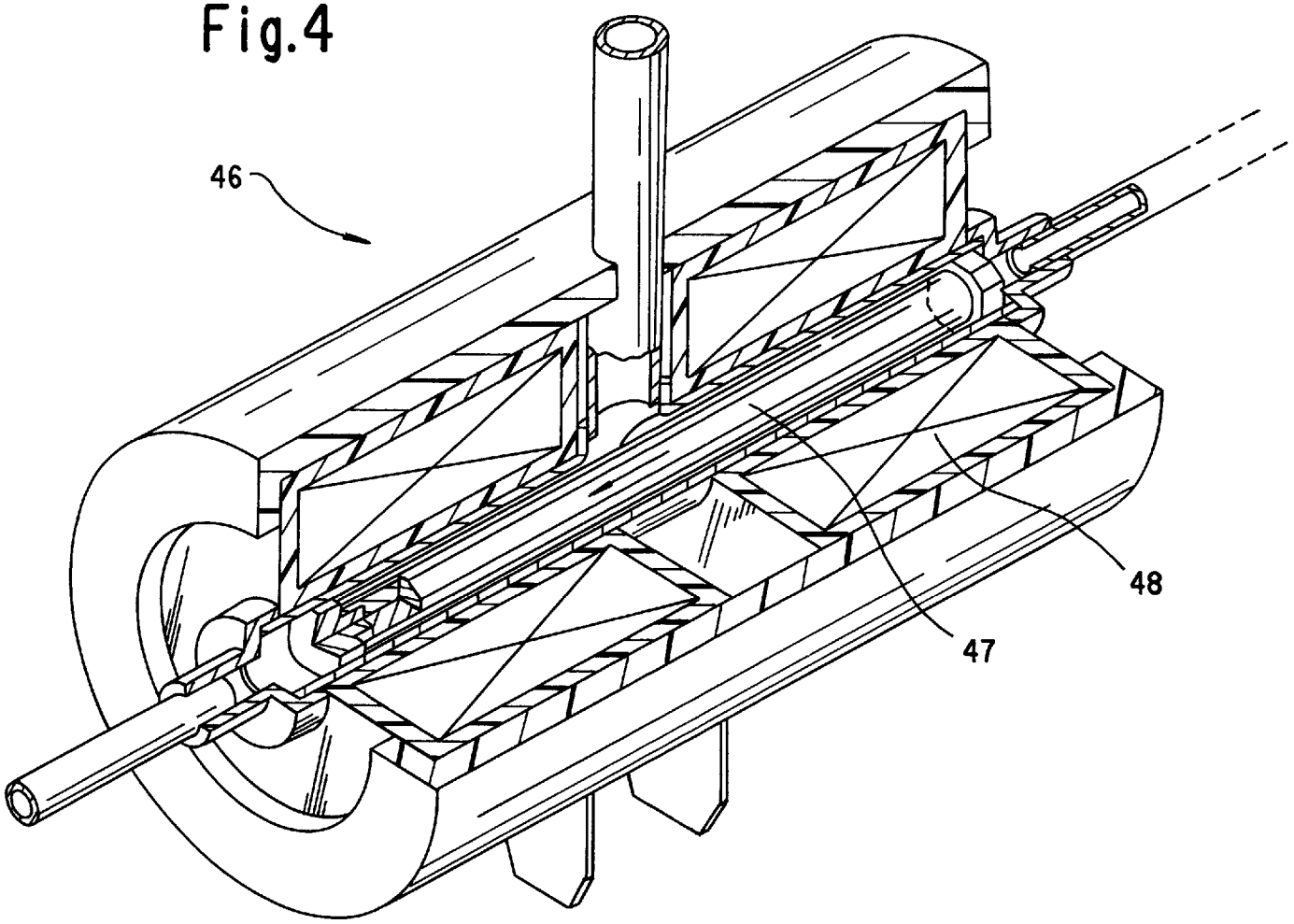
FIG. 4 is an enlarged, partially broken away, perspective view of the bistable magnet valve.

For the duration of time during which the signal "C" has a high level and the refrigerator compartment 15 demands refrigeration, the magnet valve 46 is acted upon in accordance with the positive half-waves, succeeding one another at equal time intervals, of the sinusoidal alternating voltage, as is shown at a position "1" in FIG. 3. As a result, the final control element 47 of the magnet valve 46, which element serves as an armature for an electromagnet 48 of the magnet valve 46, is held in the desired switching position to suit that need. Depending on the length of time, which is designated in FIG. 3 at the position "1" by a symbol $t_p$ (standing for the duration of the pause between triggering) and essentially corresponds to the discharging time of the capacitor 34, the signal "C" has a low level, as a result of which a high level is established at the output of the NAND Schmitt trigger 31. This high level changes the pnp transistor 43 to the blocking state, so that for this length of time the magnet valve 46 is not acted upon with any triggering power. Once this time period $t_p$ elapses, the signal "C" has a high level again, and as a result the magnet valve 46 is again acted upon by triggering power, in the form of the positive half-waves of the mains alternating voltage supply. This is done in order to assure that the valve switching element of the magnet valve 46 is reset to the required switching position if, for instance from so-called "overhead ignition" of the triac 45, the magnet valve had been moved away by the triac. A time of 30 seconds has already been established as a usable variable for a time value for the triggering pause $t_p$, while a time of 70 ms has proved to be favorable for the duration of the signal "C".

Should there be a demand for refrigeration for the freezer compartment 17, this is signaled by a high level at the output "B" of the evaluation logic element 19. Through the use of a current limiting resistor 30.2 on the input side, this high level, which is present like the signal "C" at the NAND Schmitt trigger 42, serves in the event of a demand for refrigeration for the freezer compartment 17 to trigger the pnp transistor 43 and thus also to trigger the magnet valve 46 in an appropriately targeted way through the triac 45. The triggering power of this valve, in the event of a demand for refrigeration for the freezer compartment 17, is formed by the negative half-waves of a sinusoidal alternating voltage, of the kind shown at a position "0" in FIG. 3. The course of the sinusoidal alternating voltage is evaluated by the series circuit of the diodes 39 and 40. Due to the connection of the NAND Schmitt trigger 41 in combination with the diode 41.1, only the negative half-wave, given a suitable level of the signal "C" at the output of the NAND Schmitt trigger 42, is capable of effecting a low level and therefore of making the pnp transistor 43 conducting, while the positive half-wave of the sinusoidal alternating voltage cannot bring about any controlling of the transistor 43 that serves as an electronic switch. The output-side connection of the NAND Schmitt trigger 41 to the diode 41.1, given a high level at the output "B" of the evaluation logic element 19, has the effect of causing the corresponding input signal at the NAND Schmitt trigger 42 to follow along with the output signal of the NAND Schmitt trigger 41, while if there is a low level at output "B" it is assured that this level is preserved at the input of the NAND Schmitt trigger 42, regardless of the output of the NAND Schmitt trigger 41. Analogously to the triggering of the magnet valve 46 with the positive half-waves in the position "1" shown in FIG. 3, the negative half-waves at the position "0" of FIG. 3 are supplied as triggering power to the output of the NAND Schmitt trigger 32 of the magnet valve 46 only for the duration of a high level.

In order to further assure that the valve switching element of the magnet valve 46 is located in the desired position after the switchover of the valve switching element, acting as an armature, to the intended required switching position for the freezer compartment 17, the magnet valve is acted upon from time to time with a signal train, serving as triggering power, in the form of the negative half-waves of the sinusoidal alternating voltage. The length of the signal train is determined by the duration of the high level for the signal "C", and the time period $t_p$ between the signal trains is determined by the duration of the low level for the signal "C".

I claim:

1. A circuit configuration for triggering a switching element via an electromagnet receiving a suitably targeted triggering power, comprising:

a device for switching the switching element via the electromagnet into a desired switching position in which the switching element is retained; and semiconductor components for at least briefly repeatedly acting upon the electromagnet at predetermined time intervals with a triggering power corresponding to the desired switching position, after the switchover of the switching element by the electromagnet into the desired switching position, said semiconductor components acted upon repeatedly at predetermined time intervals, in response to a single initial digital signal of one of logical "1" and logical "0", with a trigger signal serving to furnish the triggering power, after the switchover of the switching element into the desired switching position.

2. The circuit configuration according to claim 1, wherein time intervals between the trigger signals are of equal length.

3. The circuit configuration according to claim 1, wherein the triggering power is formed by half-waves of an alternating voltage, a plurality of the half-waves immediately succeeding one another are generated as a signal train, and two successive signal trains are spaced apart from one another by a period of time longer than a cycle time of the half-waves.

4. The circuit configuration according to claim 3, including a trigger unit automatically generating the trigger signals as a function of at least one triggering parameter.

5. A method for triggering a switching element via an electromagnet receiving a suitably targeted triggering power, which comprises:

switching the switching element via the electromagnet into a desired switching position in which the switching element is retained by acting upon the electromagnet with the triggering power through semiconductor components;

repeatedly at least briefly acting upon the electromagnet at predetermined time intervals with a triggering power corresponding to the desired switching position, after the switchover of the switching element by the electromagnet into the desired switching position; and in response to a single initial digital signal of one of logical "1" and logical "0", repeatedly acting upon the semiconductor components after the switchover of the switching element into the desired switching position at predetermined time intervals with a trigger signal serving to furnish the triggering power.

6. The method according to claim 5, which comprises dimensioning time intervals between the trigger signals to be of equal length.

7. The method according to claim 5, which comprises forming the triggering power by half-waves of an alternating voltage, generating a signal train from a plurality of half-waves immediately succeeding one another, and spacing two successive signal trains apart from one another by a period of time longer than a cycle time of the half-waves.

8. The method according to claim 7, which comprises generating the trigger signals automatically by with trigger unit as a function of at least one triggering parameter.

* * * * *

UNITED STATES PATENT AND TRADEMARK OFFICE

CERTIFICATE OF CORRECTION

PATENT NO. : 5,889,646
DATED : March 30, 1999
INVENTOR(S) : Georg Strauss

It is certified that error appears in the above-identified patent and that said Letters Patent is hereby corrected as shown below:

Title page,
Item [30, insert to read as follows:
-- Aug. 23, 1994 (DE) ..... P44 29 918.4 --

Signed and Sealed this

Thirtieth Day of April, 2002

*Attest:*

*Attesting Officer*

JAMES E. ROGAN
*Director of the United States Patent and Trademark Office*